United States Patent [19]

Merjan

[11] 4,293,242

[45] Oct. 6, 1981

[54] PILES

[76] Inventor: Stanley Merjan, 16 Beacon Dr., Port Washington, N.Y. 11050

[21] Appl. No.: 947,184

[22] Filed: Sep. 29, 1978

Related U.S. Application Data

[63] Continuation-in-part of Ser. No. 792,354, Apr. 29, 1977, abandoned.

[51] Int. Cl.[3] ..... E02D 5/50

[52] U.S. Cl. ..... 405/239; 405/244; 405/253

[58] Field of Search ..... 405/229, 232, 233, 237, 405/239, 243, 244, 253, 255–257

[56] References Cited

U.S. PATENT DOCUMENTS

| | | | |
|---|---|---|---|
| 1,907,654 | 5/1933 | Newman | 405/239 |
| 3,087,308 | 4/1963 | Hart et al. | 405/244 X |
| 3,581,508 | 6/1971 | Junius | 405/255 |
| 3,638,433 | 2/1972 | Sherard | 405/50 |
| 3,851,485 | 12/1974 | Steding | 405/233 |
| 3,913,337 | 10/1975 | Merjan | 405/232 |
| 4,012,915 | 3/1977 | Poma | 405/243 |

*Primary Examiner*—David H. Corbin
*Attorney, Agent, or Firm*—Abner Sheffer

[57] ABSTRACT

During the driving of a pile having an enlarged tip, uplift capacity is provided by pouring concrete into the annular space around the pile stem.

23 Claims, 18 Drawing Figures

DATA FROM PRELIMINARY BORING

PILE DRIVING DATA

| ELEV. | SOIL IDENTIFICATION | "N" VALUE | GRADE LEVEL | BLOWS PER FOOT: WITHOUT CONCRETE ANNULUS PILE "A" | | BLOWS PER FOOT: WITH CONCRETE ANNULUS PILE "B" |
|---|---|---|---|---|---|---|
| +27 | FILL SAND & CINDER | | | | | |
| +24 | | | | 9 | | 10 |
| | GRAY | 7 | | 13 | | 12 |
| | | 15 | | 17 | | 16 |
| +20 | | | | 19 | | 16 |
| | FINE | 8 | | 19 | | 18 |
| | | 12 | | 15 | | 15 |
| | SAND | | | 17 | | 11 |
| | | 6 | | 19 | | 18 |
| +15 | | 6 | | 22 | | 23 |
| | AND | | | 22 | | 20 |
| | | | | 24 | | 25 |
| | | 5 | | 15 | | 25 |
| | SILT | 5 | | 17 | | 34 |
| +10 | | | | 22 | | 32 |
| | | | | 34 | | 42 |
| | | | | 42 | | 80 |
| +8 | RED | 34 | | 65 | | 120 |
| | BROWN | 67 | | 126 | | 211/11" ② |
| +5 | COARSE | | | 11B/"x3" | ① | 20/1"FINAL |
| | TO | | | 15B/"FINAL | | |
| | FINE | | | | | |
| | SAND | 19 | | | | |
| | LITTLE | 24 | | | | |
| +0 | SILT | | | | | |

①. 11 BLOWS PER INCH FOR 3" THEN 15 BLOWS FOR NEXT INCH.

②. 211 BLOWS PER 11" THEN 20 BLOWS FOR NEXT INCH.

FIGURE 9A

PILES

This application is a continuation-in-part of my application Ser. No. 792,354 filed Apr. 29, 1977 (now abandoned), whose entire disclosure is hereby incorporated by reference.

This invention relates to piles having enlarged tips and relates especially to piles of the type described in my U.S. Pat. No. 3,913,337 issued Oct. 21, 1975.

Some pile-supported structures are occasionally subjected to uplift forces. For instance, a tank set into the ground (e.g. a tank of a sewage treatment plant) may be subjected to buoyant forces, as when the tank is empty and the water table in the surrounding ground rises above a given level, owing to flood conditions. Uplift forces can also occur as a result of wind pressure, e.g. the wind pressure may generate uplift forces under the windward side of a tall building and, simultaneously, increase the downward forces under its leeward side. Uplift piles are discussed in the book "Pile Foundations" by Robert D. Challis published by McGraw-Hill 1951 as at pages 104–106.

Certain aspects of this invention are illustrated in the accompanying drawings.

FIG. 9A gives data on the driving of two piles, one with a concrete annulus and the other without the use of the annulus.

Figure 10:
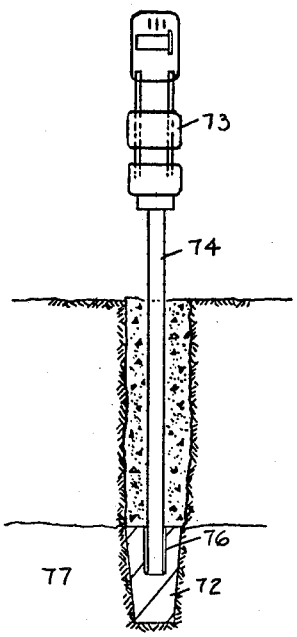
Figure 11:
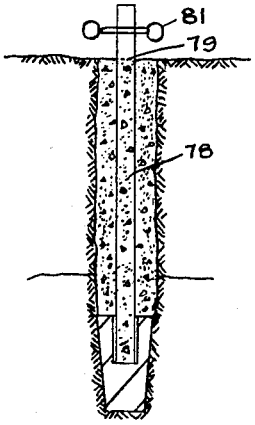
Figure 12:
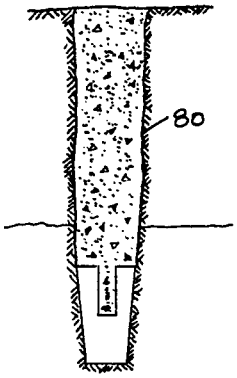
Figure 13:
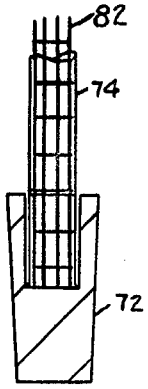
Figure 14:
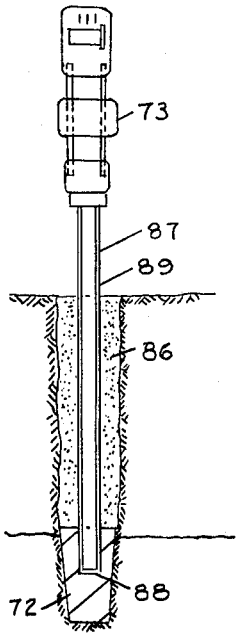
Figure 15:
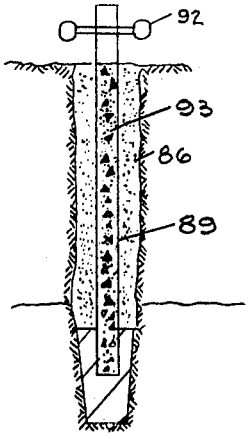
Figure 16:
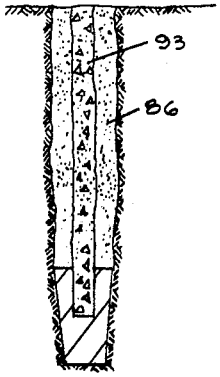
Figure 17:
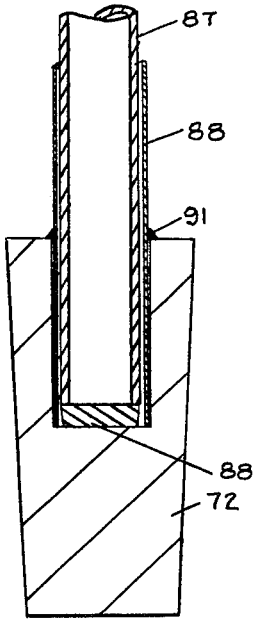

FIGS. 10, 11 and 12 are views, partly in cross-section illustrating successive stages of a method for installing an uncased pile; FIG. 13 shows a modification; and FIGS. 14, 15 and 16 are views, partly in cross-section illustrating successive stages of another method for installing an uncased pile; and FIG. 17 shows a modification.

Figure 1:
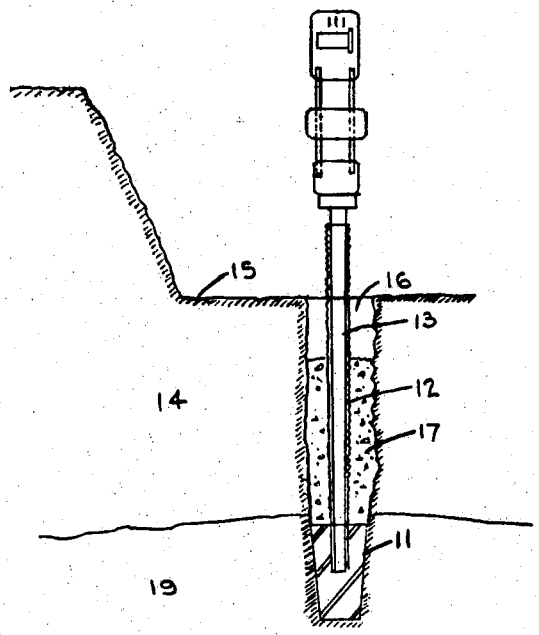
FIG. 1 is a view partly in cross-section illustrating the last stages of the driving of a pile in an area excavated for an in-ground tank.

The pile comprises a tip 11 and a stem 12. The stem may be hollow and the pile may be driven by a mandrel 13 inserted in the stem as illustrated in U.S. Pat. No. 3,913,337; a particularly suitable mandrel is that of U.S. Pat. No. 3,984,992. The pile is driven into an upper non-bearing layer 14, which may be, say, fill or "meadow mat" or one of the other non-bearing layers mentioned in U.S. Pat. No. 3,913,337. As shown in FIG. 1, when an in-the-ground tank is being constructed, the ground is first excavated (e.g. to a depth of some 5 to 30 feet) to provide below-ground space for the tank and the piles are then driven into the earth at the bottom 15 of that excavation 13.

As the pile is driven, the tip displaces the soil. The stem is considerably thinner than the tip and thus, when the top of the tip has descended below ground level of the excavation, there is an annular space 16 above the tip and around the stem. Usually, the soil around this space is unstable in the sense that it tends to fall back around the stem above the tip and thus partly fills the annular space left around the stem.

According to one aspect of this invention, wet unhardened concrete 17 is deposited into this annular space as the pile is driven. This concrete rests on top of the tip and moves down with it as the tip is driven. The pouring of the concrete may begin as soon as the top of the tip has progressed to just below ground level. The concrete may be poured continuously into the annular hole at a rate such that the top of the concrete is kept at about ground level (of the excavation). This process may continue throughout the driving of the pile; e.g., until the tip has reached such a level (in the underlying bearing layer 19 of sand) that the driving resistance has risen to the desired value, as described in U.S. Pat. No. 3,913,337. In many cases, the pouring of the concrete is discontinued before that time; that is it is discontinued when the uplift capacity of the pile is at the desired design value (as discussed below) and, after that, sand 21 or other filling soil (much less expensive than concrete) is deposited in the annular space over the descending wet concrete and/or the surrounding soil is permitted to fall into that space. Thus the top of the resulting stemsurrounding concrete plug may be well below ground level (e.g. 2 feet or more below ground level).

Less desirably, the pouring of the concrete into the annular space may be delayed until after the top of the tip is well below ground level and has a layer of caved-in soil covering it, so that the resulting hardened concrete plug rests on that intervening layer (which is compacted by the weight of the overlying wet concrete) rather directly on the top of the tip. It is better, however, to start pouring the concrete into the annular space from the beginning; in that case one may retain any compaction of the soil surrounding that space that occurred as a result of the downward movement of the tapered tip. Inspection of the driven pile and concomitant calculation of the true effective surface area (and volume) of concrete in the annular space are facilitated, however, if the concrete pouring begins substantially as soon as the top of the tip is driven below ground level and if the pouring is continued throughout the driving.

The concrete is preferably supplied in a very loose or "wet" state, having a "slump" value of at least about 9 inches (such as 9 to 11½ inches), measured by the conventional slump test (e.g. ASTM Method C143). Generally it is a conventional concrete comprising Portland cement, sand, and coarse aggregate (e.g. in a weight ratio of 1:2:4) and water. Normally this material will have an "initial set" (preliminary hardening) within about one hour of its placement and the hardening concrete will attain significant strength within about one day.

After the pile has been driven to the proper level, the pile-driving mandrel is withdrawn and (usually after similar adjacent piles have been driven) the stem 12 is filled with concrete 22 as described in U.S. Pat. No. 3,913,337. Preferably reinforcing rods are placed in the stem (of course, before the hardening of the concrete occurs in that zone or before the level of the concrete in the stem rises into that zone) for use in tying the piles firmly to the structure which the pile is to support in such manner that the uplift forces on the structure are transmitted to the pile. The same process is repeated to form a number of spaced piles and then the structure to be supported by that group of piles (e.g. a pile cap as described in U.S. Pat. No. 3,913,337 or the bottom slab 24 of the tank) is put in place (e.g. by pouring unhardened concrete to form said structure). Preferably that supported structure derives substantially all its pile bearing support from the pile stem (including the concrete filling of said stem), the stem of course being supported by the tip.

Figure 2:
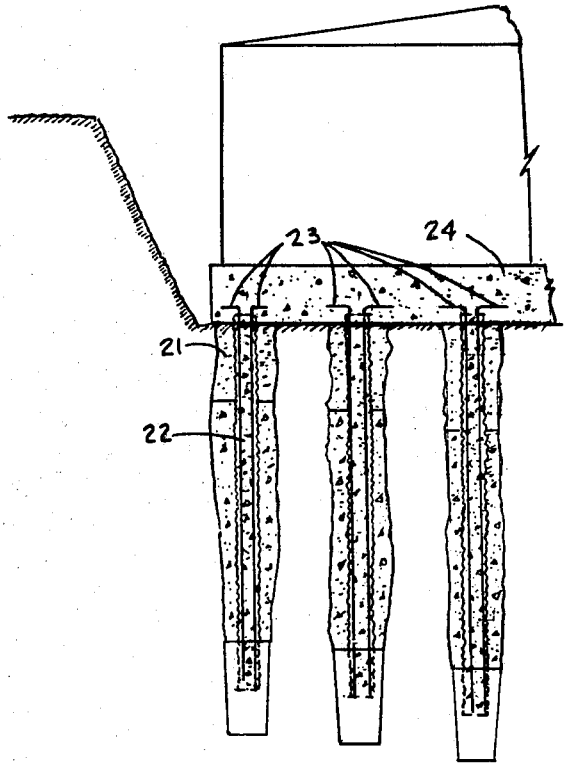
FIG. 2 is a view partly in cross-section showing a group of piles supporting, and tied to, the bottom slab of the tank.
Figure 9:
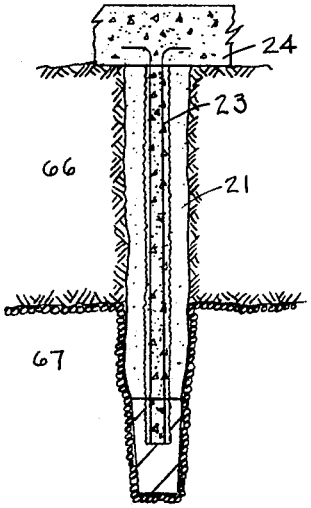
FIG. 9 is a cross-sectional view of a pile in the ground having its stem tied to the supporting structure, but without the use of a concrete annulus.

The reinforcing rods for transmitting uplift forces to the pile may, for instance, be inverted L-shaped steel rods 23 projecting above the butt (top) of the stem as illustrated. The reinforcing rods should extend a necessary depth into the stem so that the combined tensile strength of the rods and the concrete within the shell is sufficient to transfer the uplift forces to the soil around the pile stem and tip. Since the uplift stress within the pile decreases with increasing depth (as the uplift force is transferred to the surrounding soil) it is economical to use a decreased degree of reinforcement with increasing depth. For instance, one or more of the reinforcing rods may be shorter than the other(s). In FIGS. 2 and 9 the reinforcing rods 23 are shown as extending from the top of the stem down into the bottom part of stem which is within the stem-receiving socket of the tip.

Generally any load bearing support contributed by the concrete surrounding the stem (i.e. by frictional contact between that concrete and the surrounding soil) is small (less than about 5%) compared to that contributed by the pile tip and usually only the tip is considered in calculating the load-bearing capacity. Thus the driving resistance criterion for determining load-bearing capacity is generally met before the concrete surrounding the stem has hardened.

Figure 3:
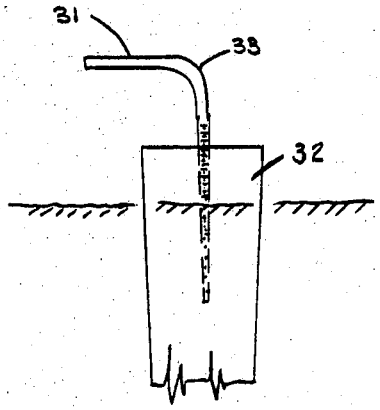
FIGS. 3 and 4 are side views showing different devices for transmitting uplift forces to pile stems.
Figure 4:
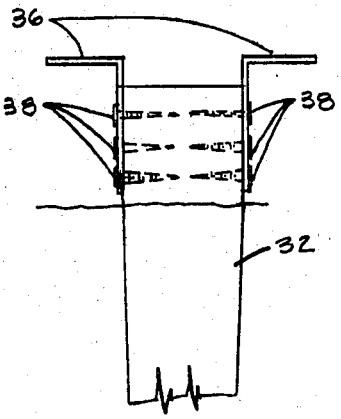

While the invention has been illustrated with piles having hollow stems that are filled in later, it may also be used with piles having preformed stems which can directly transmit the pile driving forces to the tip, such as the preformed stems described in U.S. Pat. No. 3,913,337 (e.g. wood or precast concrete). In this case the piles may be tied to the supported structure (e.g. pile cap or tank base) so that the uplift on that structure is transmitted to the pile by means such as illustrated in FIGS. 3 and 4 wherein reference numeral 31 denotes a lag screw screwed into the wood stem 32 and having a bent-over portion 33, to be embedded in, or otherwise secured to, the supported structure; reference numeral 36 designates an angle iron which is secured to the wood 32 as by a nails 38.

Figure 5:
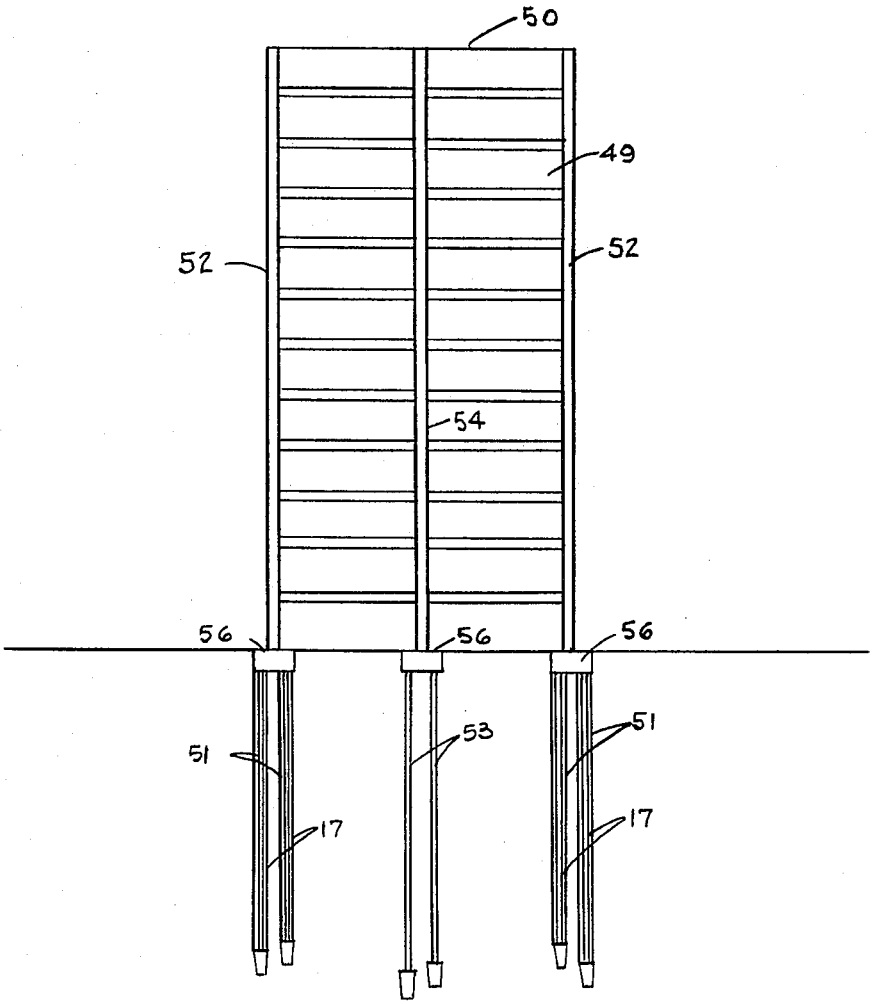
FIG. 5 is a side view of a framework of a building supported by piles and subject to uplift forces generated by wind pressure.
Figure 6:
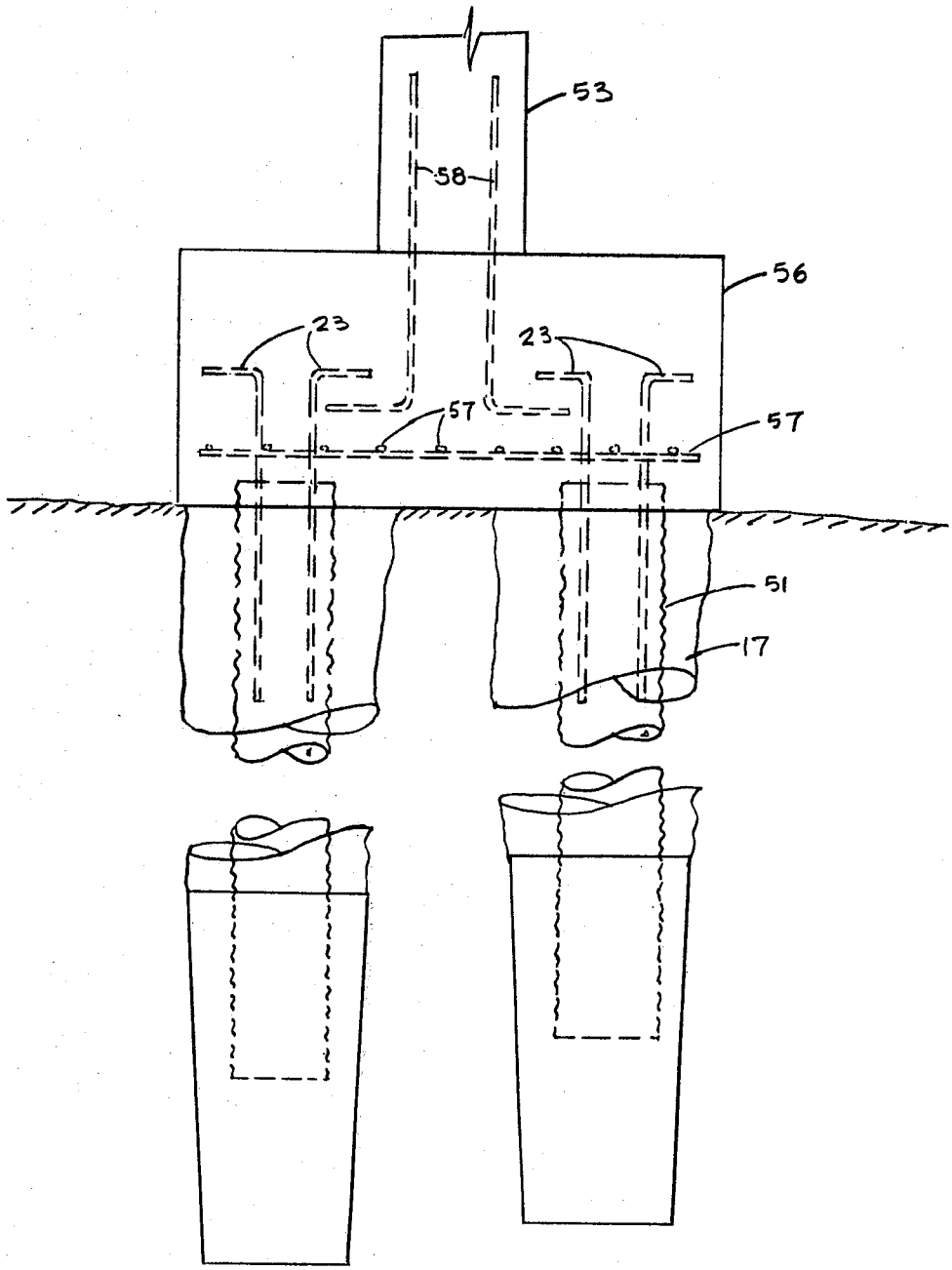
FIG. 6 is a side view, partly broken away, of a pile cap and associated piles and building column.

For in-the-ground tanks (subject to buoyant conditions) it is usually desirable for all the piles to have uplift capacity. For buildings in which the uplift forces may be generated by wind pressure, the piles underlying the general area of the outer walls may be uplift-resistant and the others may be of the unmodified type illustrated in U.S. Pat. No. 3,913,337. The outer walls and columns of the building are suitably tied to the piles through the pile caps. FIG. 5 shows a structure 49 whose height to width ratio is such that the effect of wind loading may be to cause overturning or sliding. The piles 51 shown supporting the exterior columns 52 have poured concrete annuli 17 to improve the uplift capacities and the lateral capacities, to resist any overturning and sliding loadings. The piles 53 shown supporting the interior columns 54 are not effective with respect to resisting overturning loadings because of their geometrical location, and so do not have concrete annuli. However, if the resistance to sliding forces are a critical consideration these piles may have concrete annuli to improve this capacity. The pile clusters under each column are joined by means of concrete pile caps 56 reinforced with steel bars 57 which distribute the loads from the columns to the piles as shown in FIG. 6. When sliding resistance is important it is preferred that the concrete annulus extend up to the underside of the pile cap, as illustrated in FIG. 6 so that the horizontal (sliding) force may be transmitted to the soil as close to the cap as possible to reduce the magnitude of any pile or soil stresses resulting from such horizontal force.

The value of the uplift capacity of the pile may be determined in the usual manner by reference to data obtained with test piles driven into each type of soil condition at the work site. The tests and their interpretation are discussed in the previously mentioned Chellis book, as in its Chapter 15, and are the subject of conventional building code requirements; for instance, the New York City Building Code requires that a criterion for establishing an acceptable uplift capacity is a successful load test to double the design capacity. Some ranges of expected ultimate values for skin friction, and thus uplift capacity, per square foot of bounding area are given in "Foundation Engineering" edited by G. A. Leonards published 1962 by McGraw-Hill Book Co. at page 644 Table 7-1, for stems in fine-grained (cohesive) soils and coarse-grained soils; that Table 7-1 is incorporated herein by reference.

Figure 7:
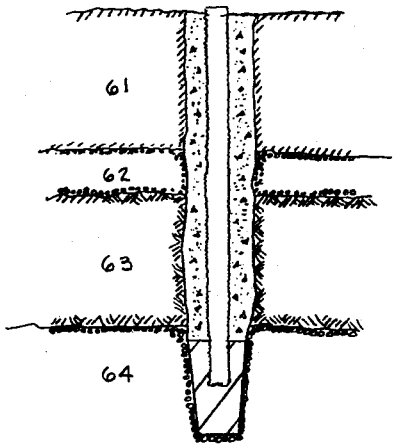
FIGS. 7 and 8 are cross-sectional views showing piles driven into two kinds of soils, before the stem is filled with concrete.
Figure 8:
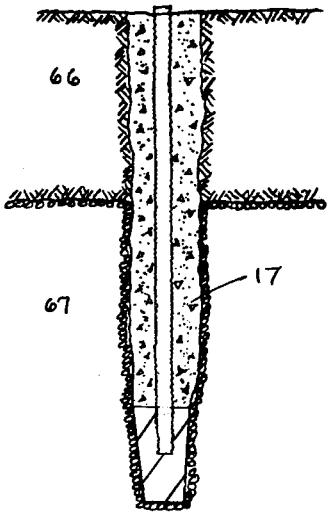

The piles of this invention are often driven through cohesive soils to a tip-bearing layer of coarse-grained soil and the uplift capacity provided by the concrete annulus is contributed by the friction between that annulus and the cohesive soil (e.g. 200–2000 pounds per square foot of contact area). Uplift capacity may also be provided by coarse-grained soils. For instance, as illustrated in FIG. 7, the soil may comprise an upper layer 61 of fill exhibiting low friction at best; a second, thin, layer of coarse-grained soil 62 (e.g. medium sand and silt) of insufficient thickness (usually less than 5 feet, e.g. 3 feet) to provide the necessary bearing capacity when the tip is driven into it but which provides friction to resist uplift forces; a third layer 63 which is of cohesive soil exhibiting low friction; and the underlying bearing layer 64 of coarse-grained soil. Another soil situation (illustrated in FIG. 8) is one in which the layers 66 overlying the coarse-grained bearing layer 67 do not provide enough friction to resist the expected uplift forces; here the pile may be "over-driven" (i.e. driven well past the level at which the driving resistance has risen to the desired value) to cause tip to penetrate sufficiently into the coarse-grained bearing layer so that the lower part (e.g. the lower 3 feet or more) of the concrete annulus 17 is in frictional contact with that coarse-grained layer. The non-bearing soil overlying the bearing layer generally comprises silt or clay in such large amounts that, unlike sand (or coarser material such as fine gravel), the soil does not become compacted by and stably supportive of the large tip which is driven into it (wet silt, for instance, will lubricate and hasten the advance of the tip); within this non-bearing soil there may be other layers (e.g. of sand) that are not thick enough to provide the bearing capacity.

The piles for which this invention is most advantageous are usually less than 40 feet long. Longer piles may have sufficient uplift capacity merely by virtue of their lengths.

Typically the stem length (above the tip) is not over about 30 feet (e.g. it is 10, 20 or 25 feet) and the conditions (including the sizes of tip and stem and the nature of the soil overlying the bearing layer) are such that the annular hole formed by driving even without the use of concrete in the annulus is so large that the underlying soil has substantially no frictional effect on the pile.

Typical sizes of tips and stems are set forth in U.S. Pat. No. 3,913,337. In general the annular space around the stem has a width (i.e. the difference between radius of tip and radius of stem) of more than 4 inches, such as at least about 6 inches, and, usually, less than about 12 inches. For instance for typical sizes described in U.S. Pat. No. 3,913,337, with tip diameters (at the top of the tip, at its widest) of about 29 to 35 or 41 inches, the width of that space is at least about six inches such as about 6½ to 12 inches; listed below are (in the named order) the stem diameter, the diameter at the top of the tip, and the width of the annular space (i.e., the difference between radius of tip and radius of stem), for several piles described in that patent (all diameters are in inches): 12 to 14, 30, 8 to 9; 10¾, 24, 6⅝; 12¾, 29, 8⅛; 16, 29, 6½; 16, 32, 8; 16, 35, 9½; 16, 38, 11; 16, 41, 12½. Uplift capacities for typical installations might be, for instance, 10 tons for a pile having a wood stem of average 10 inch diameter and a 20 foot long concrete annulus and secured into a precast concrete tapered tip having a top diameter of 19 inches, a bottom diameter of 15 inches and a height of 30 inches; 40 tons for a pile having a 16 inch diameter corrugated shell stem filled with concrete and having a 30 foot long concrete annulus with the stem socketed into a precast concrete tapered tip having a top diameter of 35 inches, a bottom diameter of 29 inches and a height of 60 inches.

The underlying coarse-grained bearing stratum in which the tip becomes lodged may be sand having an "N" value below 30, or it may be a stratum of higher "N" value, such as dense, or very dense sand having a N value of up to about 60, 70 or 80 or even higher, or it may be gravel (e.g. fine gravel) or even a layer of soft, penetrable, rock into which the tip is driven. The tabulation in FIG. 9A gives the data for the driving of two identical piles (designated as A and B), spaced about 16½ feet apart, into soil described in that tabulation. The tip penetrated into, and derived its bearing support from, a sand layer having an N value above 40, as indicated in FIG. 9A. During the driving of pile B, wet concrete was supplied to the annular space around the stem, but no such filling was supplied for pile A. Pile B was driven 8 days after pile A. Both piles had stems and tapered tips of the type illustrated in FIGS. 1 to 9; the tips were each 5 feet high and had bottom diameters of 2 feet and top diameters of 2½ feet, and the stems were conventional corrugated steel shells of 16 inch nominal diameter (about 15" i.d., 16⅛" o.d., metal thickness about 1/16", corrugations about ½ inch deep). The soil overlying the bearing layer contained a considerable proportion of silt (roughly about equal to the amount of sand). Each pile was driven with a Vulcan "0–10" hammer, exerting an energy of 32,500 foot pounds per blow. The data shows that the presence of the wet concrete annulus did not lower the driving resistance. Thus, the difference between the radii of tip and stem (i.e. the radial difference of about 7 inches) was such as to provide a sufficiently large free annular space so that soil which fell or collapsed into the hole formed by the driving of the tip without the use of the wet concrete annulus did not have any substantial frictional effect on the pile.

With respect to the data in FIG. 9A the driving resistance of about 15 to 20 blows per inch in the coarse-grained layer is equivalent to a bearing capacity in excess of 140 tons. It will also be noted that when the total pile depth was about 16 to 22 feet and the below-ground stem length (above the tip) was about 11 to 17 feet (e.g. at an elevation of about 5 to 11 feet), the driving resistances for pile B were about a foot or so out of phase with those for pile A; this is attributable to unevenness of the strata (so that for pile B, the tip encountered the ultimate bearing stratum at a slightly higher level than for pile A), the test boring having been made at a location situated at some distance (e.g. about 70 or 80 feet) from the points where the piles were driven. The driving data indicates that substantially none of the stem above the tip, and thus substantially none of the concrete annulus, is situated within the bearing stratum (of red brown coarse to fine sand).

In uplift tests it was found that pile A could withstand an uplift force of about 29 tons (of this, the weight of stem and tip contributed less than 3 tons) while pile B could withstand an uplift force of over 52.5 tons (of which the weight of the concrete annulus contributed in the neighborhood of 3 tons, over and above the weight of stem and tip.

As can be seen from the foregoing data, it has also been found that the driving of the tapered tip results in a significant uplift capacity at the tip even without the concrete annulus. For instance, when a pile having a 16 inch diameter thin corrugated shell stem attached to a symmetrical, circular tapered concrete tip (5 feet high and 23 inches in diameter at its substantially flat bottom and 29 inches in diameter at its top) was driven through a surface layer of about 5 feet of hydraulic fill (sand), a second layer of 10 feet of meadow mat and then for a distance of about 5 feet into an underlying layer of sand (so that the driving resistance rose to the design value), an uplift test on the pile showed that it could withstand an uplift force about 35 tons (which, using a factor of safety of 2, represents a design capacity of over 17 tons). The reasons for this are not fully understood; it may be a result of the compaction the coarse-grained soil by the tip coupled with a "suction" effect. In many cases the uplift capacity provided by the tip itself may be sufficient to satisfy the design requirements without the use of a concrete annulus, and it is within the broader scope of the invention (as illustrated in FIG. 9) to employ such piles without annuli (but with provision for tying the stem to the supported structure) in place of the concrete-surrounded piles discussed above. Of course there should also be provision for securing the stem to the tip in such fashion that the uplift force is transmitted to the tip; thus, the corrugations in the socket of the tip receiving the corrugated shell stem may serve this purpose or a pipe stem may be welded to a pipe socket within the tip.

In the 35 ton uplift test of the unjacketed pile, described above, the pile was, as usual, driven by a mandrel within the corrugated stem, the mandrel was withdrawn and the stem was filled with concrete, but in this case a reinforcing element was placed within the stem, prior to filling with concrete, in order to insure the transmission of uplift forces to the tip. There was no jacket or other filling placed around the stem; the driving of the pile (to the depth described above) caused the formation of an annular hole about 4 or 5 feet deep around the stem; this was then backfilled, loosely, with sand without any significant compaction of that fill. The water table was about 5 feet below ground level. The ultimate load-bearing capacity of the pile was sufficient to meet the 90 ton design capacity and was thus (with the factor of safety of 2 used for the design) some 180 tons or more. The tips were as described in U.S. Pat. No. 3,913,337.

Another aspect of this invention relates to the use of precast concrete pile tips, as described in U.S. Pat. No. 3,913,337, with cast-in-place concrete stems having no casings. There are several ways in which such an uncased pile may be produced. FIGS. 10, 11 and 12 show a sequence of installation where an annulus of fresh, loose concrete 71 is deposited above the tip 72 as it is driven in the ground. A conventional pile hammer 73 together with a steel pipe mandrel 74 (whose bottom is open and is received in the socket 76 of the tip) is used to drive the pile tip. During the driving wet unhardened concrete may be deposited into the annular space around the casing, as in the manner previously described herein; thus this concrete may be dropped from the ground surface or piped by means of concrete pumping apparatus. When the pile tip reaches the designated soil bearing strata 77 and the criteria for the intended design capacity of the pile has been reached by virtue of resistance to penetration under the blows of the hammer and/or the length of the pile in the designated soil strata, the driving is stopped. Fresh concrete 78 is then placed (e.g. piped) into the mandrel, filling it to the level of the top of pile 79 as called for by the design considerations of the structure under construction. The mandrel is then lifted out to remove it, while the concrete outside and inside the mandrel is still wet and hardenable. The concrete flows into the relatively thin space previously occupied by the walls of the mandrel and hardens together with the concrete of the annulus to form a monolithic stem 80. Preferably the mandrel is vibrated as by a vibrator 81 during the mandrel removal step to help to assure the continuity and freedom from voids in the body of concrete in the ground. If uplift capacity is desired, reinforcement to give tensile strength to the body of concrete may be placed within the mandrel (e.g. a suitable wire reinforcing cage 82, FIG. 13, having means for tying it to the overlying structure may be placed in the mandrel before the driving begins or at some later time, preferably prior to the time when the concrete is placed within the mandrel); then the mandrel may be raised up out of the ground while the reinforcement is left behind, within the concrete.

Another method for installing an uncased type of pile is shown in the sequence of FIGS. 14, 15, 16. In this method sand 86 or other granular soil (such as pea gravel or broken stone) may be used instead of loose concrete to fill the annular space above the pile tip during the driving. Again a conventional pile hammer 73 is used to drive the pile tip 72 together with a steel pipe mandrel 87, which in this application, may have a plate 88 welded to its bottom. However, in this embodiment the mandrel is surrounded by a temporary casing 89; this casing may be a steel pipe whose inside diameter may, for instance, be one half inch (or more) greater than the diameter of the mandrel and about one half inch less than the diameter of the unlined socket in the pile tip. Bituminous or other waterproofing material may be used in the joint 91 (FIG. 17) between the casing and the socket to prevent water or soil or sand from entering into the bottom of the temporary casing. The sand being poured into the annulus around the temporary casing is preferably in a wet state such that on contact with wet concrete it will not act to draw water out of the concrete; it may be poured continuously into the annulus as the pile is being driven. When the driving has continued to the stage that the pile has met all of the criteria for design capacity, as discussed above, the driving is stopped and the mandrel is withdrawn. The casing is then filled with fresh concrete and thereafter withdrawn, preferably while the casing is being vibrated, e.g. by means of a vibrator 92. The bituminous or other waterproofing material in joint 91 has insufficient strength to interfere significantly with the upward withdrawal of the casing from the tip. The material of the annulus may flow into the space previously occupied by the casing walls and into contact with the concrete, which serves to confine the concrete. If uplift capacity is desired, reinforcement (such as a wire reinforcing cage) may be placed in the casing, e.g. after the mandrel is withdrawn.

The placement of concrete within the temporary casing 89, and the withdrawal of the casing, may be effected incrementally.

Thus wet concrete may be deposited in the casing, so as to fill, say, the lower 5 feet of the casing, then the casing may be raised a distance less than the height of that concrete filling (preferably at least 3 feet less, e.g. raised by 1½ to 2 feet) and the mandrel may be dropped onto the surface of the concrete to ram the wet concrete below the bottom of the casing firmly against the sand annulus. This intermittent process may be repeated for the entire height of the pile (or for a part thereof, the balance of the concrete placement being carried out by a single deposit as previously described).

It is understood that the foregoing detailed description is given merely by way of illustration and that variations may be made therein without departing from the spirit of the invention.

I claim:

1. Process which comprises driving a pile having a hollow stem and an enlarged preformed lower tip, which tip has a diameter of at least 19 inches, through overlying non-bearing soil into an underlying bearing layer of sand in which the driving causes said enlarged tip to penetrate into said underlying layer and the driving is continued into said underlying layer until the resistance to the driving force shows that the designed load bearing capacity of the pile has been attained, said tip having a central, upwardly open, socket and the bottom part of said stem being fitted in said socket, the driving of said enlarged tip forming an annular space around said stem above said tip and above said underlying layer, said method including the steps of supplying wet, flowable, concrete to said annular space during said driving to form an annular body of said flowable concrete in said annular space and in contact with said stem and with the soil surrounding said annular space, permitting said flowable concrete to set after said driving is completed, providing tying means for transmitting uplift forces at the top of said stem and including reinforcing rods extending through said stem from the top of said stem into said bottom part of said stem within said socket, filling said hollow stem with unhardened concrete and permitting said concrete to set in said stem and around said reinforcing rods, said stem being secured to said tip in such fashion that uplift forces are transmitted to said tip, forming a group of piles by driving at least one other pile adjacent to the first-mentioned pile and casting concrete over said group and around said tying means to form a pile-supported structure, said hardened concrete in said annular space increasing the uplift capacity of said first-mentioned pile, the relationship between said pile and the soil being such that any load bearing support contributed by the concrete surrounding the stem by frictional contact between said surrounding concrete and the soil is less than 5% of the load bearing support contributed by said tip; the dimensions or said tip and stem being such that the width of the annular space around the stem is at least about 6 inches and the length of the stem in the soil is not over about 30 feet, said tying means being constructed and arranged so as to have sufficient strengths to transmit an uplift force of 52.5 tons per pile to said stem.

2. Process as in claim 1 in which said overlying layer is of cohesive soil having frictional contact with said hardened concrete in said annular space.

3. Process as in claim 2 in which said cohesive soil has a skin friction of 200–2000 pounds per square foot of contact area.

4. Process as in claim 1 in which said underlying layer has an N value less than 30.

5. Process as in claim 1 in which said piles are driven into the ground at the base of an excavation for an in-the-ground tank, and said tank is placed on said piles, said pile-supported structure comprising the base of said tank, said pile driving being at a location at which said emplaced tank is subject to uplift forces resulting from rises in the water table surrounding said tank.

6. Process as in claim 1 in which said pile-supported structure is at least a portion of the foundation of a building subject to winds which generate uplift forces at at least one side of said building, said process including the steps of installing means for tying said pile-supported structure to said side of the building so as to transmit said forces to said first-mentioned pile.

7. Process as in claim 1 in which said tip is of reinforced concrete and tapered to increase in diameter from its bottom upwards for an axial distance of at least 2 feet, the taper being less than about 3 inches per foot and the axial height of the tip being at least about 2 feet.

8. Process as in claim 7 in which said stem is a thin corrugated tubular metal shell incapable of withstanding pile driving blows, said pile is driven by blows on a mandrel extending down through said shell, and after the driving of said pile said mandrel is withdrawn, said shell is filled with concrete and said tying means are set into the top of said shell to be held by the concrete therein.

9. Process as in claim 8, in which said overlying layer is of cohesive soil having frictional contact with said hardened concrete in said annular space, said cohesive soil has a skin friction of 200–2000 pounds per square foot of contact area, said underlying layer has an N value of less than 30 said tip diameter is 29 to 41 inches and said width is at least 6½ inches.

10. Process as in claim 9 in which said tip diameter is 29 to 35 inches, and said width is 6½ to 12 inches.

11. Process as in claim 1 in which the relationship of tip, stem and soil is such that the presence of the wet concrete annulus does not substantially lower the driving resistance and none of the stem above the tip is within said underlying bearing layer.

12. A load-carrying pile in place in the ground said pile having a concrete-filled hollow stem extending through overlying non-bearing soil and having an enlarged preformed lower tip which has a diameter of at least 19 inches and which is embedded in an underlying bearing layer of sand penetrated by said tip and thereby supporting said pile, said tip having a central, upwardly open, socket and the bottom part of said stem being fitted in said socket, an annular body of set concrete around and in contact with said stem and with the soil of said overlying layer, which body of concrete has been set while in said contact with said soil and has substantially the same diameter as the widest diameter of said tip, the upper portion of said pile having typing means for transmitting uplift forces to said pile from a structure supported by said pile and including reinforcing rods extending through said stem from the top of said stem into said bottom part of said stem within said socket, said stem being secured to said tip in such fashion that uplift forces are transmitted to said tip, said annular concrete body being in sufficient contact with said soil and said stem to restrain said pile from undesired upward movement in response to said uplift forces, the relationship between said pile and the soil being such that any load bearing support contributed by the concrete surrounding the stem by frictional contact between said surrounding concrete and the soil is less than 5% of the load bearing support contributed by said tip; the dimensions of said tip and stem being such that the width of the annular space around the stem is at least about 6 inches and the length of the stem in the soil is not over about 30 feet, said tying means being constructed and arranged so as to have sufficient strength to transmit an uplift force of 52.5 tons per pile to said stem.

13. A pile as in claim 12 in which said overlying layer is of cohesive soil having a skin friction of 200–2000 pounds per square foot of contact area.

14. A pile as in claim 12 in which said tip is of reinforced concrete and tapered to increase in diameter from its bottom upwards for an axial distance of at least 2 feet, the taper being less than about 3 inches per foot and the axial height of the tip being at least about 2 feet.

15. A pile as in claim 12 in which said stem is a thin corrugated tubular metal shell incapable of withstanding pile driving blows, said shell is filled with concrete and said tying means are set into the top of said shell and held in said shell by said concrete filling.

16. A pile as in claim 12 in combination with an in-the-ground tank supported thereby at a location at which said tank is subject to uplift forces resulting from rises in the water table surrounding said tank, the construction and arrangement being such that at least a portion of the latter uplift forces are transmitted to said pile.

17. A pile as in claim 12 in combination with a pile-supported building subject to winds which generate uplift forces at at least one side of said building, the construction and arrangement being such that at least a portion of the latter uplift forces are transmitted to said pile.

18. A pile as in claim 15 in which said overlying layer is of cohesive soil having a skin friction of 200–2000 pounds per square foot of contact area, said tip is of reinforced concrete and tapered to increase in diameter from its bottom upwards for an axial distance of at least 2 feet, the taper being less than about 3 inches per foot and the axial height of the tip being at least about 2 feet, said tip diameter is 29 to 41 inches and said width is at least 6½ inches.

19. A pile as in claim 18 in which said tip diameter is 29 to 35 inches, and said width is 6½ to 12 inches.

20. A driven load-carrying pile in place in the ground, said pile having a concrete-filled hollow stem extending through at least one overlying layer of soil and having a preformed lower tip which is embedded by the driving of said pile in an underlying bearing layer of sand compacted by the driving of said tip into said sand and thereby supporting said pile, said tip having a central, upwardly open, socket and the bottom part of said stem being fitted in said socket, said tip being of reinforced concrete and tapered to increase in diameter from its bottom upwards for an axial distance of at least 2 feet, the taper being less than about 3 inches per foot and the axial height of the tip being at least about 2 feet said stem having a cross-sectional area less than half that of the upper portion of said tip, said stem being in contact with the soil of said overlying layer, said driven tip being resistant to uplift from said underlying layer, said pile having tying means for transmitting uplift forces to said tip from a structure supported by said pile and including reinforcing rods extending through said stem from the bottom of said stem into said bottom part of said stem within said socket, said stem being secured to said tip in such fashion that uplift forces are transmitted to said tip, the length of said stem in the soil being not over about 30 feet, said tying means being constructed and arranged so as to have sufficient strength to transmit an uplift force of about 29 tons per pile to said stem.

21. A pile as in claim 20 in which said stem is a thin corrugated tubular metal shell incapable of withstanding pile driving blows, said shell is filled with concrete and said tying means are situated within said concrete filing.

22. A pile as in claim 21 in combination with an in-the-ground tank supported thereby at a location at which said tank is subject to uplift forces resulting from rises in the water table surrounding said tank, the construction and arrangement being such that at least a portion of the latter uplift forces are transmitted to said pile.

23. A pile as in claim 20 in combination with a pile-supported building subject to winds which generate uplift forces at at least one side of said building, the construction and arrangement being such that at least a portion of the latter uplift forces are transmitted to said pile.

* * * * *